US006160894A

United States Patent [19]

Kishigami et al.

[11] Patent Number: 6,160,894

[45] **Date of Patent: *Dec. 12, 2000**

[54] SPEAKER APPARATUS AND SOUND REPRODUCTION SYSTEM EMPLOYING SAME

[75] Inventors: Jun Kishigami, Saitama; Masao Fujihira, Kanagawa; Takahiro Muraguchi, Tokyo, all of Japan

[73] Assignee: Sony Corporation, Tokyo, Japan

[ * ] Notice: This patent is subject to a terminal disclaimer.

[21] Appl. No.: 08/861,163

[22] Filed: May 21, 1997

[30] Foreign Application Priority Data

May 28, 1996 [JP] Japan ..... 8-156178
Dec. 27, 1996 [JP] Japan ..... 8-359044

[51] Int. Cl.[7] ..... H04R 3/00

[52] U.S. Cl. ..... 381/111; 381/117

[58] Field of Search ..... 381/401, 117, 381/111

[56] References Cited

U.S. PATENT DOCUMENTS

| | | | |
|---|---|---|---|
| 4,145,945 | 3/1979 | Iyeta | 84/1.18 |
| 4,504,704 | 3/1985 | Ohyaba et al. | 381/117 |
| 4,566,120 | 1/1986 | Nieuwendijk et al. | 381/117 |
| 4,720,868 | 1/1988 | Hirano | 381/182 |
| 5,347,587 | 9/1994 | Takahashi et al. | 381/117 |
| 5,796,843 | 8/1998 | Inanaga et al. | 381/17 |
| 5,862,237 | 1/1999 | Kishigami et al. | 381/117 |

FOREIGN PATENT DOCUMENTS

| | | | |
|---|---|---|---|
| 4129793 | 4/1993 | Germany | H04R 3/00 |
| 56-131294 | 10/1981 | Japan | H04R 3/00 |
| 57-138293 | 8/1982 | Japan | H04R 3/00 |
| 57-185793 | 11/1982 | Japan | H04R 3/00 |
| 59-034795 | 2/1984 | Japan | H04R 3/00 |
| 61-206397 | 9/1986 | Japan | H04R 9/04 |

*Primary Examiner*—Forester W. Isen
*Assistant Examiner*—Brian T. Pendleton
*Attorney, Agent, or Firm*—Jay H. Maioli

[57] ABSTRACT

A speaker apparatus capable of reproducing from low-pitched to high-pitched sounds and a voice reproduction system employing the same. The speaker apparatus includes a speaker unit in which a primary coil is mounted in a gap portion between a plate and a center pole of a magnetic circuit, a secondary coil is disposed within the gap in such a manner as to be fixed to a vibration plate, and a secondary electric current is induced in the secondary coil by a signal current flowing through a primary coil, thereby operating the vibration plate; and a speaker driving circuit adapted to drive the primary coil of the speaker unit in accordance with a digital sound signal.

8 Claims, 14 Drawing Sheets

FIG. 5

| ELECTRIC CURRENT | MSB | 2SB | 3SB | 4SB | 5SB | 6SB | 7SB | 8SB | 9SB | 10SB | 11SB | 12SB | 13SB | 14SB | 15SB | LSB |
|---|---|---|---|---|---|---|---|---|---|---|---|---|---|---|---|---|
| + | 0 | 1 | 1 | 1 | 1 | 1 | 1 | 1 | 1 | 1 | 1 | 1 | 1 | 1 | 1 | 1 |
| | 0 | 1 | 1 | 1 | 1 | 1 | 1 | 1 | 1 | 1 | 1 | 1 | 1 | 1 | 1 | 0 |
| | 0 | 1 | 1 | 1 | 1 | 1 | 1 | 1 | 1 | 1 | 1 | 1 | 1 | 1 | 0 | 1 |
| | 0 | 1 | 1 | 1 | 1 | 1 | 1 | 1 | 1 | 1 | 1 | 1 | 1 | 1 | 0 | 0 |
| | | | | | | | | | | | | | | | | |
| | 0 | 0 | 0 | 0 | 0 | 0 | 0 | 0 | 0 | 0 | 0 | 0 | 0 | 0 | 1 | 1 |
| | 0 | 0 | 0 | 0 | 0 | 0 | 0 | 0 | 0 | 0 | 0 | 0 | 0 | 0 | 1 | 0 |
| | 0 | 0 | 0 | 0 | 0 | 0 | 0 | 0 | 0 | 0 | 0 | 0 | 0 | 0 | 0 | 1 |
| 0 | 0 | 0 | 0 | 0 | 0 | 0 | 0 | 0 | 0 | 0 | 0 | 0 | 0 | 0 | 0 | 0 |
| | 1 | 1 | 1 | 1 | 1 | 1 | 1 | 1 | 1 | 1 | 1 | 1 | 1 | 1 | 1 | 0 |
| | 1 | 1 | 1 | 1 | 1 | 1 | 1 | 1 | 1 | 1 | 1 | 1 | 1 | 1 | 0 | 1 |
| | 1 | 1 | 1 | 1 | 1 | 1 | 1 | 1 | 1 | 1 | 1 | 1 | 1 | 1 | 0 | 0 |
| | | | | | | | | | | | | | | | | |
| | 1 | 0 | 0 | 0 | 0 | 0 | 0 | 0 | 0 | 0 | 0 | 0 | 0 | 0 | 1 | 1 |
| | 1 | 0 | 0 | 0 | 0 | 0 | 0 | 0 | 0 | 0 | 0 | 0 | 0 | 0 | 1 | 0 |
| | 1 | 0 | 0 | 0 | 0 | 0 | 0 | 0 | 0 | 0 | 0 | 0 | 0 | 0 | 0 | 1 |
| − | 1 | 0 | 0 | 0 | 0 | 0 | 0 | 0 | 0 | 0 | 0 | 0 | 0 | 0 | 0 | 0 |
| COIL | 1P | 1N | 1M | 1L | 1K | 1J | 1I | 1H | 1G | 1F | 1E | 1D | 1C | 1B | 1A | |

SPEAKER APPARATUS AND SOUND REPRODUCTION SYSTEM EMPLOYING SAME

BACKGROUND OF THE INVENTION

1. Field of the Invention

The present invention relates to a speaker apparatus for acoustic reproduction and a sound reproduction system employing the same.

2. Description of the Related Art

Various types of speakers for acoustic reproduction have been conceived and made practical.

Speaker units have been practically formed as electromagnetically coupled (electromagnetically induced type) speakers in which, for example, a magnet is sandwiched between a center pole portion provided in a yoke and a plate, forming a magnetic circuit having a gap between the center pole portion and the plate, within the gap of the magnetic circuit, a primary coil is fixed to the center pole portion or the plate, and a secondary coil which forms a short coil is disposed within the gap of the magnetic circuit in such a manner as to be fixed to a vibration plate so as to face the primary coil.

In this electromagnetically coupled speaker, a secondary electric current is induced in the secondary coil by a signal current flowing through the primary coil. Due to the interaction with the magnetic flux which occurs in the gap of the magnetic circuit, a driving force responsive to the secondary electric current is produced in the secondary coil in accordance with Fleming's left-hand rule, causing the vibration plate to which the secondary coil is fixed to deflect. In this way, the vibration plate is moved, thereby generating a sound.

This electromagnetically coupled speaker has the advantages of having excellent heat dissipation properties and the capability of withstanding a large input because the primary coil through which a signal current flows is fixed to a center pole portion or a plate formed from a magnetic material, such as iron. Further, if the secondary coil which forms a short coil is formed from a non-magnetic conductive material, for example, a cylindrical member for the length of one turn formed from, for example, aluminum, distortion can be reduced.

On the other hand, a dynamic (electroconductive type) speaker having a voice coil disposed within a gap in a magnetic circuit is made practical. In this dynamic speaker, electric power is supplied to a voice coil, and the voice coil is connected to an input terminal provided in a speaker frame by means of a coil extension wire made of tinsel wire so that unwanted vibration and resistance are not applied to the vibration system including the voice coil.

Further, in this dynamic speaker, it is considered that the voice coil is divided into portions corresponding to the number of bits of a digital sound signal, and that the respective coils are directly driven by data of the corresponding respective bits of the digital sound signal.

As described above, the electromagnetically coupled speaker has the advantages of having excellent heat dissipation properties and the capability of withstanding a large input, and further is capable of reducing distortion. However, if the width of the gap in the magnetic circuit is increased, the magnetic sensitivity of the primary coil and the secondary coil is decreased; therefore, it is not possible to increase the number of turns of the primary coil and the secondary coil.

For this reason, it is not possible to increase the inductances of the primary coil and the secondary coil, and the electromagnetic coupling force by which a secondary electric current is induced in the secondary coil by the signal current flowing through the primary coil is reduced at a low frequency of below several kHz. Therefore, reproduction of, for example, from 1 kHz to 20 Hz required for sound reproduction cannot be sufficiently made. Due to this, the electromagnetically coupled speaker is used mainly as a speaker for reproducing high-pitched sounds.

On the other hand, as described above, in a dynamic speaker, a voice coil is connected to an input terminal provided in the speaker frame by means of a coil extension wire made of tinsel wire. Further, in the dynamic speaker, it is considered that the voice coil is divided into portions for the number of bits of a digital sound signal, and that the respective coils are directly driven by data from each bit of the digital sound signal.

However, at present, in a case where a sound signal is digitized, it is common practice to form the digital sound signal with 16 bits for the purpose of faithful sound reproduction. For this reason, in a dynamic speaker, when a voice coil is driven in accordance with a digital sound signal, 16 pairs (i.e., 32 wires) of coil extension wires become necessary for one speaker.

However, since the tinsel wire, which is a coil extension wire, greatly swings with the vibration of the voice coil because the tinsel wire is extended from a moving object, namely, a moving voice coil, it is not possible to decrease the distance between them. Therefore, it is very difficult to provide as many as 32 tinsel wires in a speaker. In particular, it is difficult to manufacture a small-size speaker.

SUMMARY OF THE INVENTION

Accordingly, in the present invention, reproduction down to a low frequency is made possible by an electromagnetically coupled speaker.

The present invention provides a speaker unit having a primary coil fixed to a portion in the vicinity of a gap in a magnetic circuit formed with the gap, and having a secondary coil disposed within the gap in such a manner as to be fixed to a vibration plate, a secondary electric current being induced in the secondary coil by a signal current flowing through the primary coil, causing the vibration plate to deflect; and a speaker driving circuit which drives the primary coil of the speaker unit with a digital sound signal.

As a sampling frequency in a case where a sound signal is digitized, a high frequency of twice 20 kHz, which is said to be the upper limit of audible frequencies or thereabouts, for example, 44.1 kHz or 48 kHz, is used. Therefore, low-frequency components of below 1 kHz of a sound signal before digitization become high frequencies exceeding 20 kHz as a digital sound signal.

Further, in the electromagnetically coupled speaker, even if the gap width of a magnetic circuit is decreased, and the number of turns of the primary coil and the secondary coil is decreased so as to prevent sensitivity from decreasing, the electromagnetic coupling force thereof is not decreased when the frequency of the signal current flowing through the primary coil is a high frequency such as exceeding 20 kHz, making sound reproduction possible.

In the speaker apparatus of the present invention constructed as described above, since the primary coil of the electromagnetically coupled speaker is driven in accordance with a digital sound signal, low-frequency components of the sound signal before digitization become high frequencies exceeding 20 kHz as a signal current flowing through the primary coil. Therefore, reproduction down to a low frequency is made possible by an electromagnetically coupled speaker.

Further, the present invention provides a speaker unit having a primary coil fixed to a portion in the vicinity of a gap in a magnetic circuit formed with the gap, and having a secondary coil disposed within the gap in such a manner as to be fixed to a vibration plate, a secondary electric current being induced in the secondary coil by a signal current flowing through the primary coil, causing the vibration plate to deflect; and a speaker driving circuit which drives the primary coil of the speaker unit with an analog sound signal, wherein the speaker driving circuit interrupts the analog sound signal at a frequency higher than an audible frequency, In the speaker apparatus of the present invention constructed as described above, since an analog sound signal is interrupted at a frequency higher than an audible frequency and is supplied to the primary coil of the electromagnetically coupled speaker, low-frequency components of the analog sound signal also become high frequencies exceeding 20 kHz as a signal current flowing through the primary coil. Therefore, reproduction down to a low frequency is made possible by an electromagnetically coupled speaker.

The above and further objects, aspects and novel features of the invention will become more apparent from the following detailed description when read in connection with the accompanying drawings.

BRIEF DESCRIPTION OF THE DRAWINGS

FIG. 5 is an illustration of an example of a digital sound signal;

DESCRIPTION OF THE PREFERRED EMBODIMENTS

Figure 1:
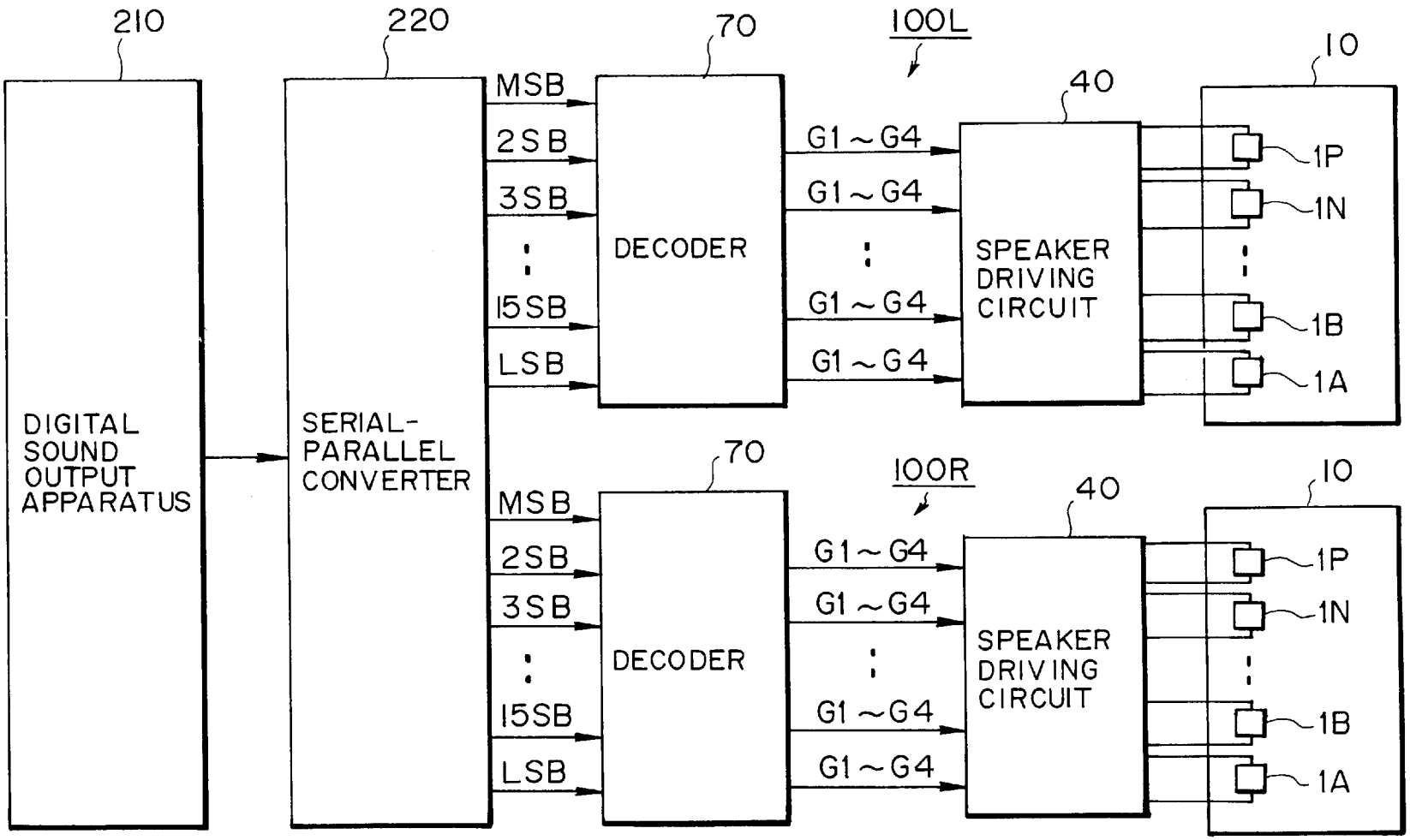
FIG. 1 is a block diagram illustrating an example of a sound reproduction system employing a speaker apparatus of the present invention.

FIG. 1 shows an example of a sound reproduction system employing a speaker apparatus of the present invention, and also illustrates a case in which sound is reproduced in accordance with a digital sound signal from a digital sound output apparatus.

A digital sound output apparatus 210 is a CD player, a DAT (digital audio tape) recorder or the like. From a digital output terminal thereof, a stereo sound signal formed of left and right sound signals, which are digitized into 16 bits at a sampling frequency of, for example, 44.1 kHz or 48 kHz, is output as serial data at every one sampling alternately with respect to left and right sound data.

The 16-bit digital sound signal of the serial data from the digital sound output apparatus 210 is supplied to a serial-parallel converter 220 whereby left and right digital sound signals are separated, and each signal is converted into parallel data. The left and right digital sound signals which have been formed into parallel data are supplied to left and right speaker apparatuses 100L and 100R.

In this example, the left and right speaker apparatuses 100L and 100R each comprise a decoder 70, a speaker driving circuit 40, and a speaker unit 10. In each decoder 70, a control signal to be described later is generated from the 16-bit digital sound signal which has been converted into parallel data by the serial-parallel converter 220. The control signal is supplied to the speaker driving circuit 40, causing the speaker driving circuit 40 to drive a primary coil, to be described later, of the speaker unit 10.

Figure 2:
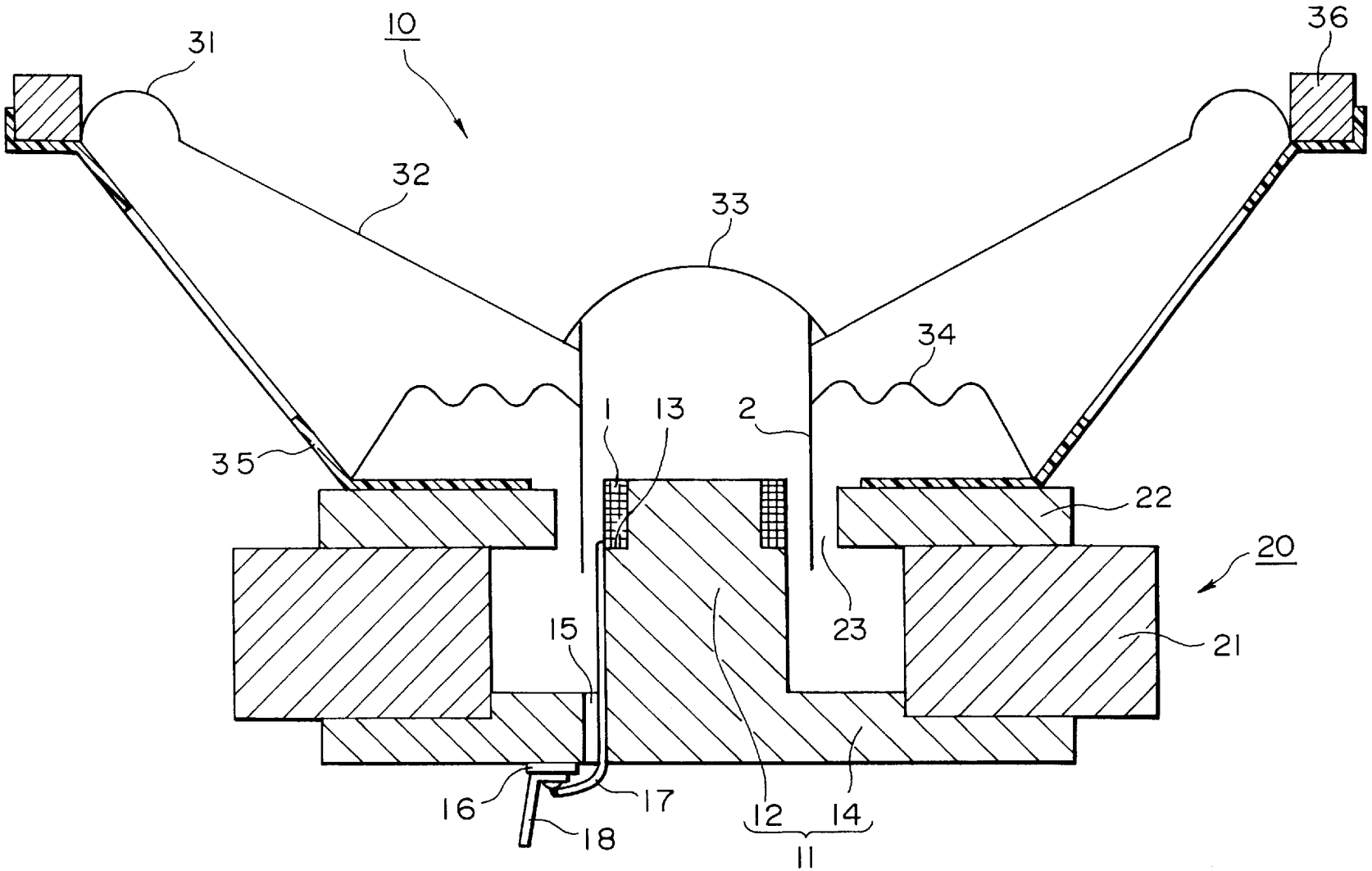
FIG. 2 is a sectional view illustrating an example of a speaker unit.

FIG. 2 shows an example of the speaker unit 10. In the speaker unit 10 of this example, a recess portion 13 is formed around the tip portion of a center pole portion 12 of a yoke 11 such that a circular cylindrical center pole portion 12 is integrally provided vertically in the central portion of a circular-plate-shaped flange portion 14, and a primary coil 1 is fitted into the recess portion 13 and thus mounted to the center pole portion 12.

The primary coil 1, in which a plurality of turns of conductors are wound in a ring form, is fitted and bonded to the recess portion 13, and thus mounted to the center pole portion 12. Alternatively, a plurality of turns of conductors are directly wound around the recess portion 13, and thus the primary coil 1 is mounted to the center pole portion 12. Alternatively, though not shown, a plurality of turns of conductors are wound around a magnetic bobbin, and the magnetic bobbin is fitted into the recess portion 13, and thus the primary coil 1 is mounted to the center pole portion 12.

An opening (hole) 15 is formed in a flange portion 14 of the yoke 11 at a position continuously adjacent to the center pole portion 12, and a terminal plate 16 is mounted on the back of the flange portion 14. Then, a coil extension wire 17 made of, for example, tinsel wire, of the primary coil 1 is inserted into the opening 15 in such a manner as to be bonded to the peripheral surface of the center pole portion 12, and connected by soldering to an input terminal 18 on the terminal plate 16.

The coil extension wire 17 is provided for each winding beginning and the winding end of the primary coil 1, with each being connected to the separate input terminals. Further, in a case where the primary coil 1 is formed of a plurality of coils, as will be described later, the coil extension wire 17 of each coil is inserted into the opening 15 in such a manner as to be bonded to the peripheral surface of the center pole portion 12 and connected to the input terminal 18 on the terminal plate 16.

A ring-shaped magnet 21 is bonded to the front of the flange portion 14 of the yoke 11, and a plate 22 is bonded to the front of the ring-shaped magnet 21, forming a magnetic circuit 20 having a gap 23 between the outer peripheral surface of the tip portion of the center pole portion 12 and the inner peripheral surface of the plate 22.

Within the gap 23 of the magnetic circuit 20, a secondary coil 2 which forms a short coil is inserted. In this example, the secondary coil 2 is made into a cylindrical member by molding a non-magnetic conductive material, for example, aluminum, and is made a coil for the length of one turn.

The secondary coil 2 has mounted thereto a cone 32 with an edge 31 on the outer peripheral portion thereof and a damper 34 in such a way that the central openings of the cone and the damper are fitted and bonded. A cap 33 is mounted in such a manner as to cover the central opening of the cone 32 so as to form a lid. Further, a speaker frame 35 is mounted to the plate 22, the edge 31 on the outer peripheral portion of the cone 32 and a gasket 36 are mounted to the speaker frame 35, and the outer peripheral portion of the damper 34 is mounted to the speaker frame 35.

Figure 3:
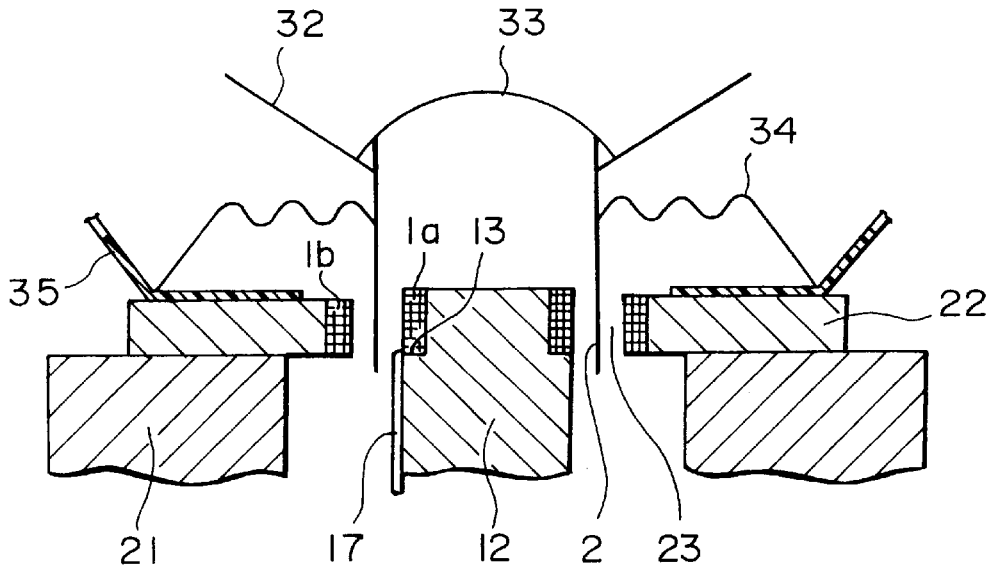
FIG. 3 is a sectional view illustrating another example of the speaker unit.
Figure 4:
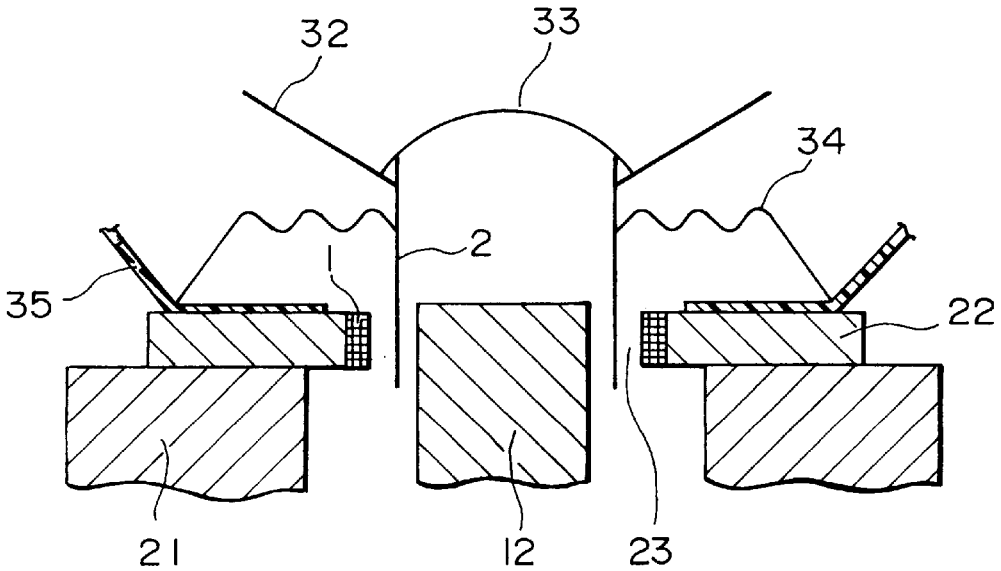
FIG. 4 is a sectional view illustrating still another example of the speaker unit.

As shown in FIG. 3, a coil 1*a* of a part of the primary coil 1 may be mounted to the peripheral surface of the tip portion of the center pole portion 12, and a coil 1*b* of the remainder may be mounted to the inner peripheral surface of the plate 22. In this case, the coil extension wire of the coil 1*b* mounted to the plate 22, though not shown, is inserted, for example, between the plate 22 and the magnet 21, and is connected to the input terminal on the terminal plate mounted to the outer peripheral surface of the plate 22. Further, as shown in FIG. 4, the entire primary coil 1 may be mounted to the inner peripheral surface of the plate 22. The coil extension wire in this case also is inserted between the plate 22 and the magnet and is guided out to the outside.

As shown in FIGS. 2, 3 and 4, the bobbin around which the secondary coil 2 is wound may be omitted by forming the secondary coil 2 from a cylindrical member for one turn. The number of parts can be decreased as a result of forming without a bobbin by omitting the bobbin, and the magnetic sensitivity can be increased by decreasing the width of the gap 23 by an amount corresponding to the thickness of the bobbin.

Figure 6:
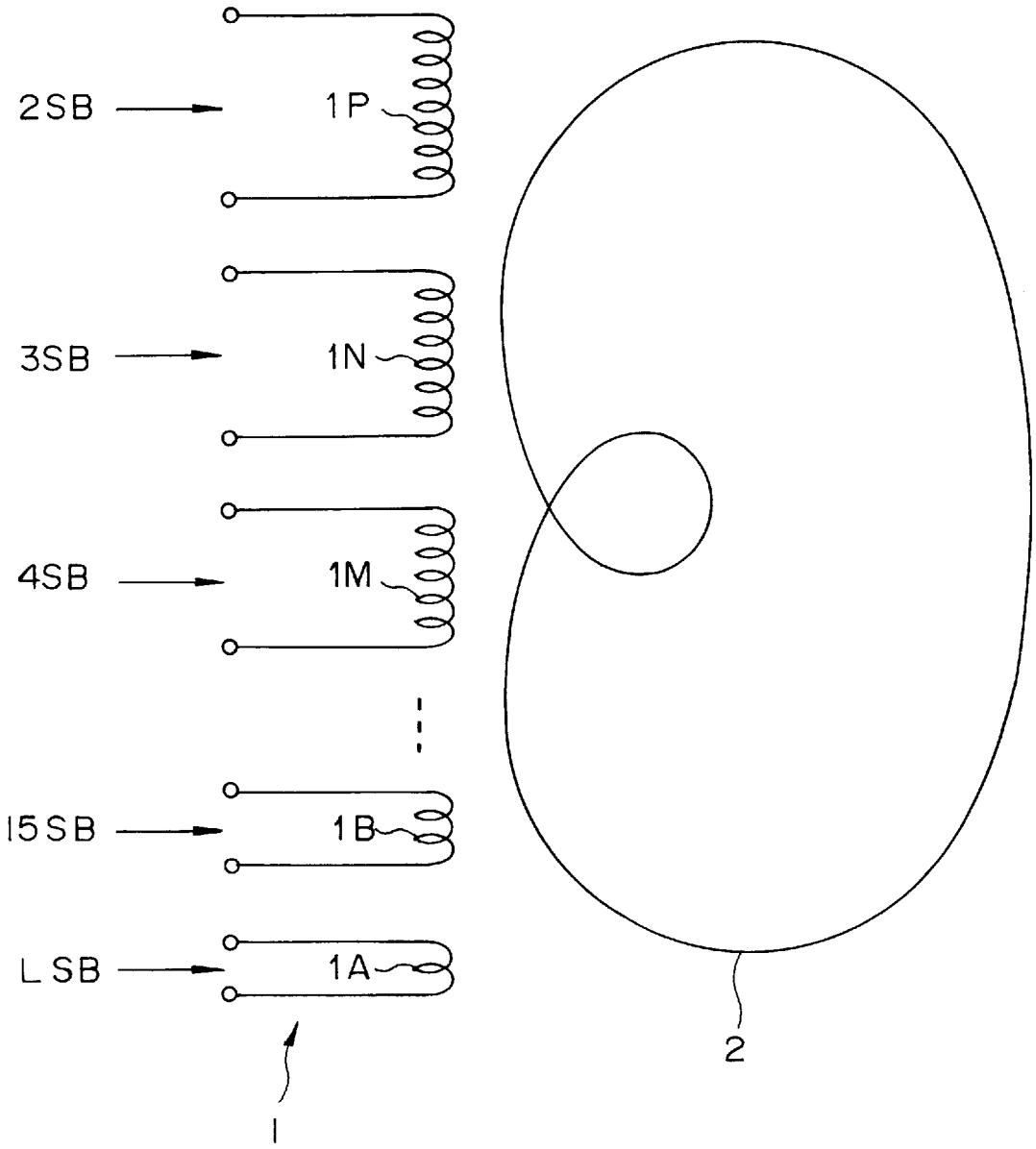
FIG. 6 shows an example of the coil structure of the speaker unit.

In an example in which the primary coil is formed of a plurality of coils, when a 16-bit digital sound signal from the serial-parallel converter 220 shown in FIG. 1 is a two's complement code shown in FIG. 5 and a signal which is quantized linearly, with the MSB (most significant bit) thereof as a sign bit, as shown in FIGS. 5 and 6, the primary coil is formed of 15 coils 1A, 1B . . . 1N, 1P, and the coil 1A is made to correspond to the LSB (least significant bit) and formed of, for example, 2 turns. Hereinafter, the coils 1B, 1C, 1D, 1E, 1F, 1G, 1H 1I, 1J, 1K, 1L, 1M, 1N, and 1P are made to correspond to 15SB, 14SB, 13SB, 12SB, 11SB, 10SB, 9SB, 8SB, 7SB, 6SB, 5SB, 4SB, 3SB, and 2SB, and are formed from twice the number of turns of a coil corresponding to a bit which is one order lower and thus has 4, 8, 16 turns . . . .

Figure 7:
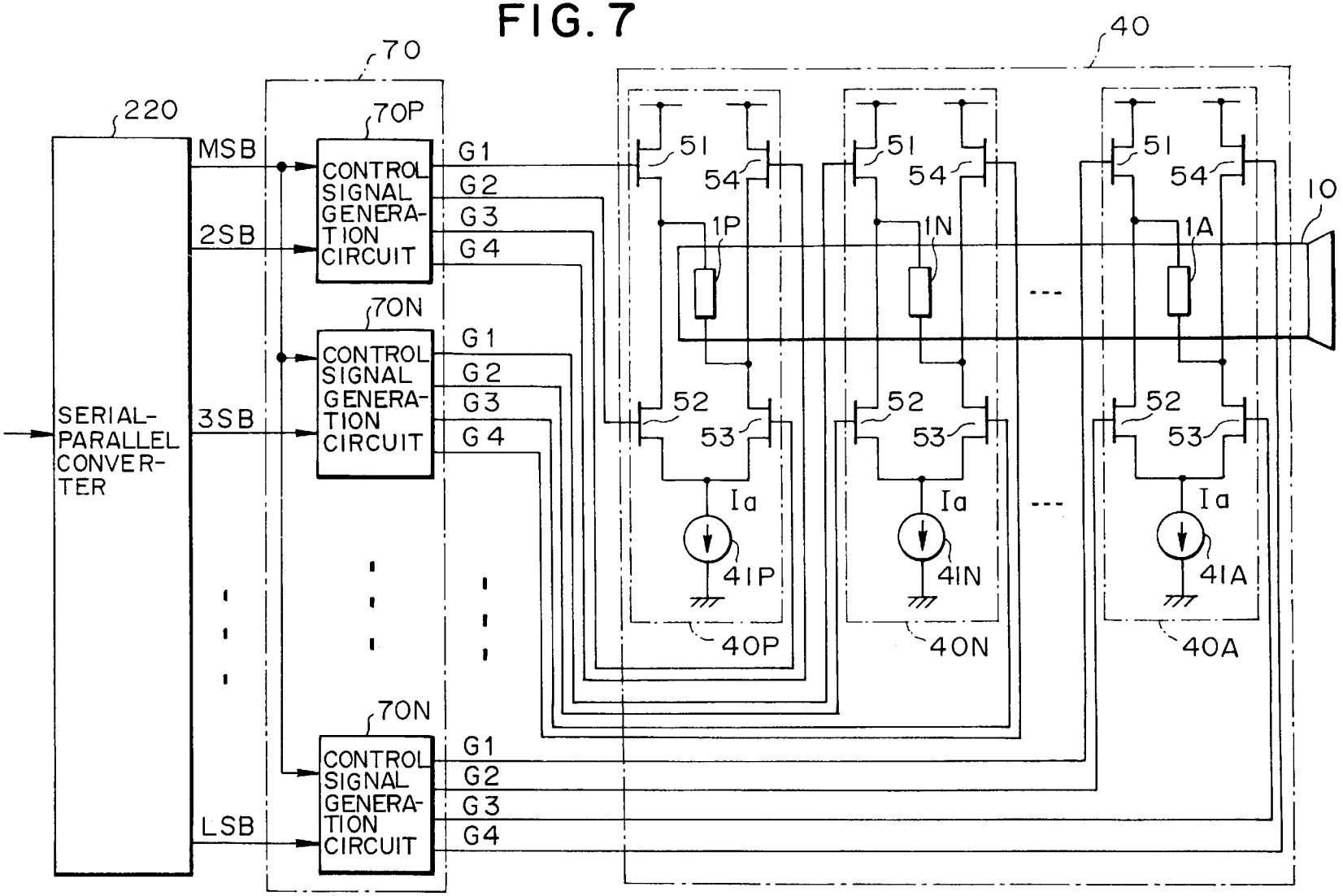
FIG. 7 is a connection diagram illustrating an example of a speaker apparatus of the present invention.

FIG. 7 shows in detail examples of the portions of the speaker unit 70 and the speaker driving circuit 40 shown in FIG. 1 in such a case. The speaker driving circuit 40 includes 15 coil driving circuits 40A to 40N, and 40P in correspondence with the 15 coils 1A to 1N, and 1P of the primary coil 1.

The respective coil driving circuits 40A to 40N, and 40P are formed in such a way that constant-current sources 41A to 41N, and 41P, four FETs 51 to 54 each serving as a switching element, and corresponding coils 1A to 1N, and 1P are bridge-connected. When FETs 51 and 53 are turned on and FETs 52 and 54 are turned off, an electric current Ia of a corresponding constant-current source flows in a positive direction through a corresponding coil. When FETs 51 and 53 are turned off and FETs 52 and 54 are turned on, an electric current Ia of a corresponding constant-current source flows in a negative direction through a corresponding coil.

All the electric currents of the constant-current sources 41A to 41N, and 41P are made into an identical electric-current value as indicated by electric current Ia. In the same coil driving circuit, when all the FETs 51 to 54 are turned on or off, no electric current flows through a corresponding coil.

The decoder 70 includes 15 control signal generation circuits 70A to 70N, and 70P in correspondence with the 15 coils 1A to 1N, and 1P, that is, 15 bits, excluding the MSB of the digital sound signal from the serial-parallel converter 220. From the respective control signal generation circuits 70A to 70N, and 70P, four control signals G1 to G4, each of which will be described later, can be obtained on the basis of the MSB of the digital sound signal and lower-order bits (LSB to 2SB) corresponding to the respective control signal generation circuits 70A to 70N, and 70P from the serial-parallel converter 220. The control signals G1 to G4 are supplied to the gates of the FETs 51 to 54 of the corresponding coil driving circuits 40A to 40N, and 40P of the speaker driving circuit 40.

Regarding the four control signals G1 to G4, when the MSB of the digital sound signal from the serial-parallel converter 220 is 0 and the corresponding lower-order bit is 1, the control signals G1 and G3 reach a level at which the FETs 51 and 53 are turned on, and the control signals G2 and G4 reach a level at which the FETs 52 and 54 are turned off. When the MSB is 0 and the corresponding lower-order bit is also 0, or when the MSB is 1 and the corresponding lower-order bit is also 1, the control signals G1 to G4 reach a level at which the FETs 51 to 54 are turned off. When the MSB 1 and the corresponding lower-order bit is 0, the control signals G1 and G3 reach a level at which the FETs 51 and 53 are turned off, and the control signals G2 and G4 reach a level at which the FETs 52 and 54 are turned on.

Therefore, when the MSB is 0 and only when a certain lower-order bit is 1, electric current Ia flows in a positive direction through the primary coil corresponding to this bit. In contrast, when the MSB is 1 and only when a certain lower-order bit is 0, electric current Ia flows in a negative direction through the primary coil corresponding to this bit.

The driving force F of the vibration system of an electromagnetically coupled speaker is expressed in the following relation F=BLi as a product of a secondary electric current i induced in the secondary coil, the density B of a magnetic flux which occurs in the gap of a magnetic circuit, and the length L of the secondary coil present within the gap of the magnetic circuit. Since the magnetic-flux density B and the length L are constant, the driving force F of the vibration system is proportional to the secondary electric current i induced in the secondary coil. The secondary electric current i induced in the secondary coil is proportional to the product of a signal current which flows through the primary coil and the number of turns (impedance) of the primary coil.

In the above-described example, as a result of setting the number of turns of each of the coils 1A to 1N, and 1P of the primary coil 1 to the number of turns proportional to the weight of each bit excluding the MSB of the digital sound signal from the serial-parallel converter 220, when electric current Ia flows as a signal current through a certain primary coil, a secondary electric current of a current value proportional to the weight of the bit corresponding to that primary coil is induced in the secondary coil 2, in a direction responsive to the value of the MSB of the digital sound signal from the serial-parallel converter 220.

Therefore, the cone 32 to which the secondary coil 2 is fixed deflects by an amount proportional to the weight of the bit corresponding to that primary coil, in a direction responsive to the value of the MSB of the digital sound signal from the serial-parallel converter 220. Thus, in the speaker unit 10, sound is reproduced faithfully to the digital sound signal from the serial-parallel converter 220.

In this case, the digital sound signal from the serial-parallel converter 220 is a signal digitized at a sampling frequency of, for example, 44.1 kHz or 48 kHz, and each of the coils 1A to 1N, and 1P of the primary coil 1 is driven in accordance with a digital signal of the same sampling frequency. Therefore, the low-frequency components of the sound signal before digitization become high frequencies exceeding 20 kHz as a signal current which flows through the coils 1A to 1N, and 1P of the primary coil 1.

Therefore, reproduction down to a low frequency becomes possible with the speaker unit 10 which is an electromagnetically coupled speaker, and thus it is possible to realize a full-range speaker which reproduces from low-pitched to high-pitched sounds.

Similar to a conventional speaker, the vibration system of the speaker unit 10 does not readily respond to a high frequency, and in particular, hardly reproduces components of a high frequency such as over 20 kHz. Therefore, even if each of the coils 1A to 1P of the primary coil 1 is driven with a digital signal of a sampling frequency of 44.1 kHz or 48 kHz, that sampling frequency component is hardly reproduced. If the components were reproduced at a very small sound pressure, sound of over 20 kHz can hardly be heard by the human ear; therefore, no problem is presented when listening to music. Further, it is easy to intentionally form and incorporate a mechanical filter with 20 kHz or higher as an attenuation band into the speaker unit 10 so that the sampling frequency is surely not reproduced.

Furthermore, it is possible to realize a speaker apparatus having a small amount of distortion and a large maximum output which directly reproduces sound in accordance with a digital sound signal without using a D/A converter or a power amplifier.

The sound reproduction system of FIG. 1 can be prevented from being enlarged by forming it in such a way that, for example, components from the serial-parallel converter 220 to the speaker driving circuit 40 are formed into an IC, which is connected to the digital sound output apparatus 210, and moreover the speaker unit 10 is connected to this apparatus.

As the switching elements of the coil driving circuits 40A to 40N, and 40P, in addition to FETs, other elements which operate at high speed may be used.

There is a case in which a certain bit of the digital sound signal from the serial-parallel converter 220 becomes a value at which a signal current flows through a corresponding primary coil in a period of a plurality of continuous sampling cycles.

Figure 8:
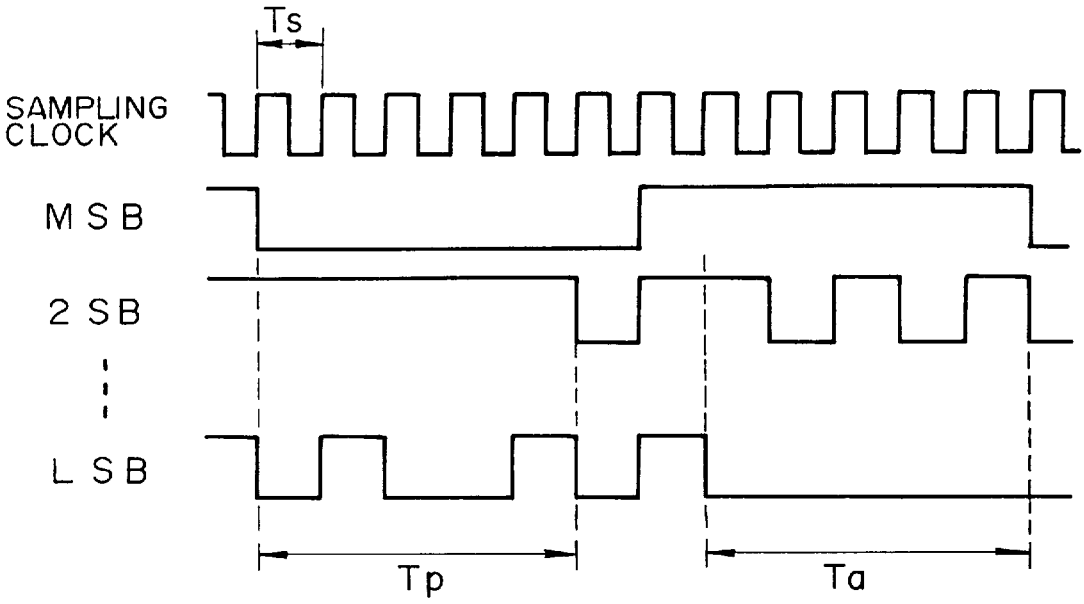
FIG. 8 is an illustration of the mode of data of each bit of a digital sound signal.

More specifically, in a case where the digital sound signal from the serial-parallel converter 220 is a two's complement code shown in FIG. 5, as shown in FIG. 8, there is a case in which in a period Tp of a plurality of continuous sampling cycles, MSB becomes 0 and, for example, 2SB becomes 1, and in a similar period Ta, MSB becomes 1 and, for example, LSB becomes 0. At such a time, in the period Tp, electric current Ia flows continuously in a positive direction through the primary coil 1P, and in the period Ta, electric current Ia flows continuously in a negative direction through the primary coil 1A.

However, in this case, the apparent sampling frequency of data of 2SB and LSB is decreased, and becomes 1 kHz when, for example, periods Tp and Ta are 1 msec. For this reason, the electromagnetic coupling force of the speaker unit 10 is reduced, and optimum driving of the speaker unit 10 is not attained.

Accordingly, in the decoder 70 shown in FIGS. 1 and 7, a period in which a signal current does not flow through a corresponding primary coil is set for every sampling frequency in the data of each bit excluding the MSB of the digital sound signal from the serial-parallel converter 220.

Figure 9:
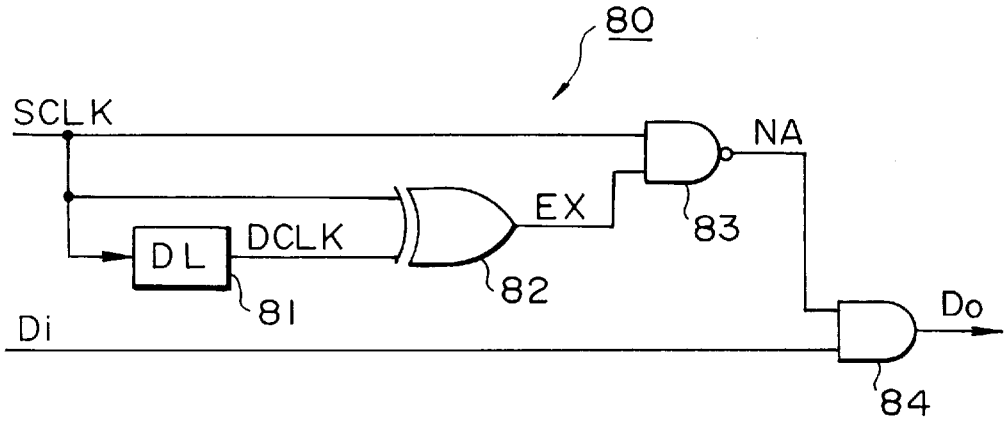
FIG. 9 shows an example of a non-driving period setting circuit.

FIG. 9 shows an example of a circuit for setting non-driving period in which a signal current does not flow in such a case. As a part of the decoder 70, this non-driving period setting circuit 80 is provided for each bit, excluding the MSB, of the digital sound signal from the serial-parallel converter 220. However, shown in the figure is a non-driving period setting circuit corresponding to one bit from among them.

Figure 10:
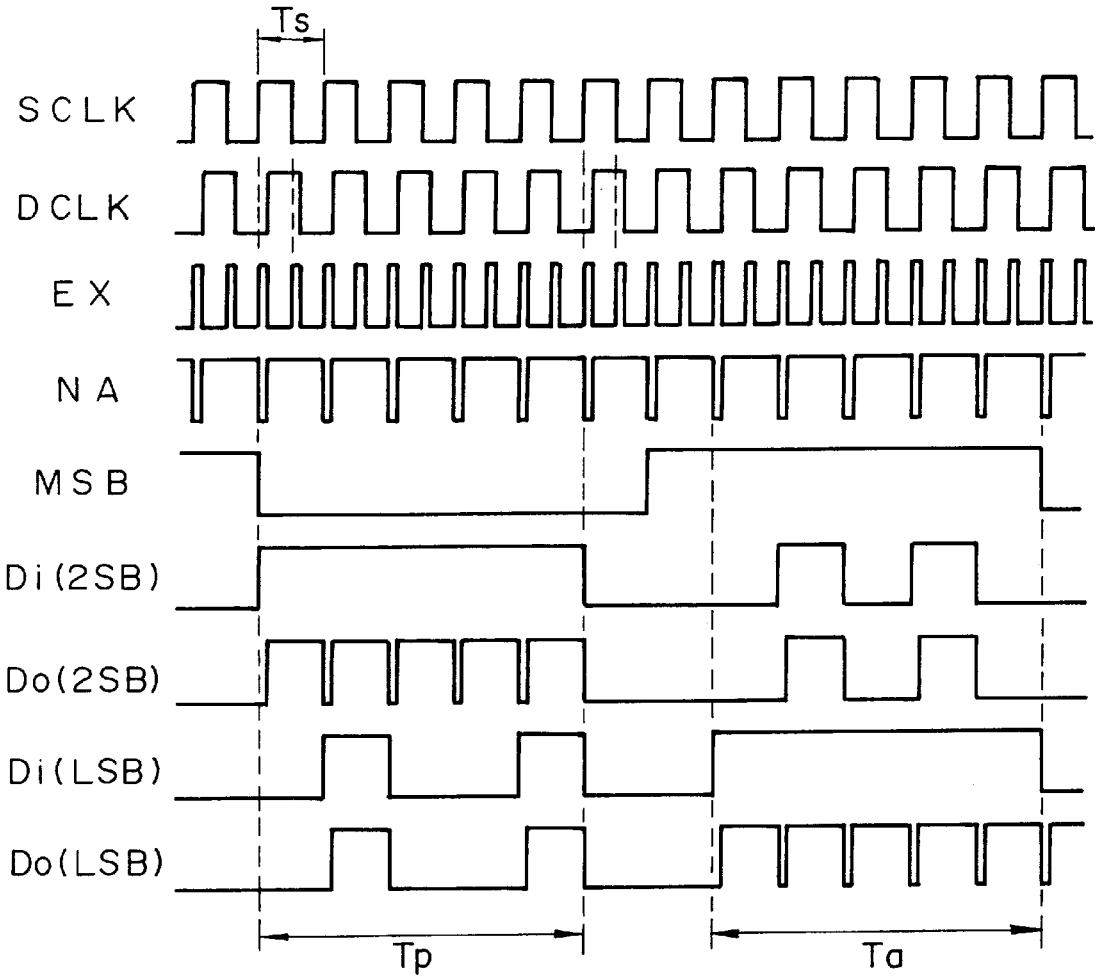
FIG. 10 shows timing waveforms of signals present in the circuit of FIG. 7 and in the non-driving period setting circuit shown in FIG. 9.

In the non-driving period setting circuit 80, a clock SCLK, shown in FIG. 10, which is synchronized with the digital sound signal from the serial-parallel converter 220 and whose frequency is equal to the sampling frequency of the digital sound signal, and a clock DCLK, shown in FIG. 10, which is delayed by a time shorter than a sampling cycle Ts of the digital sound signal by a delay circuit 81 are supplied to an exclusive OR circuit 82 whereby a signal EX shown in FIG. 10 is obtained. The signal EX and the clock SCLK are supplied to a NAND circuit 83 whereby a signal NA shown in FIG. 10 is obtained. The signal NA and input data Di of a corresponding bit are supplied to an AND circuit 84 whereby output data Do is obtained.

When the MSB is 0, original input data Di is kept as is. When the MSB is 1, the original input data Di is inverted on the input side of the non-driving period setting circuit 80. Therefore, when the original data of the 2SB and LSB are such as those shown in FIG. 8 in relation with the value of the MSB, the data of the 2SB and LSB become such as those shown as data Di (2SB) and Di (LSB) in FIG. 10.

Therefore, at this time, data of the 2SB is such that, as output data Do of the non-driving period setting circuit 80, a period in which the amount of delay time in the delay circuit 81 becomes 0 is set every sampling cycle Ts, as shown as Do (2SB) in FIG. 10. In a similar manner, data of the LSB is such that, as output data Do of the non-driving period setting circuit 80, a period in which the amount of delay time in the delay circuit 81 becomes 0 is set every sampling cycle Ts, as shown as Do (LSB) in FIG. 10.

In the decoder 70 shown in FIGS. 1 and 7, the above-described control signals G1 to G4 are generated from the output data Do of the non-driving period setting circuit 80. Therefore, in a similar manner, the control signals G1 to G4 also become such that a period of an amount of time shorter than the sampling cycle Ts, at which a signal current does not flow through a corresponding primary coil, is set every sampling cycle Ts.

Therefore, regardless of the contents of the digital sound signal from the serial-parallel converter 220, the electromagnetic coupling force of the speaker unit 10 is not reduced because the apparent sampling frequency of data of each bit of the digital sound signal is decreased. Thus, the speaker unit 10 is always optimally driven. The shorter the period during which the signal current does not flow, the better, and the period is determined on the basis of the relationship to the characteristics of elements to be used.

Figure 11:
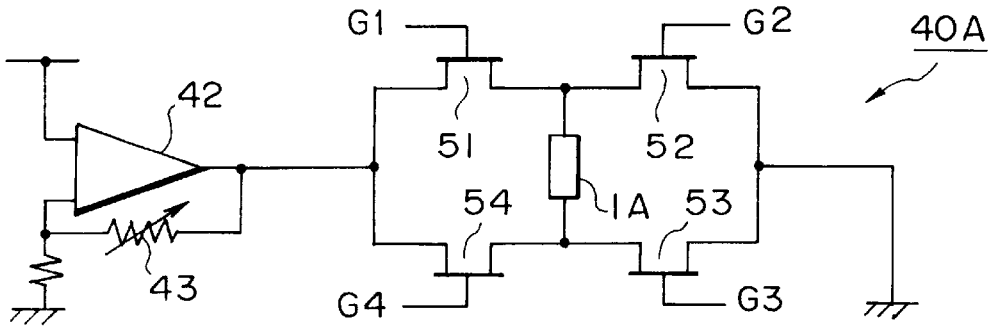
FIG. 11 is a connection diagram illustrating an example of a coil driving circuit using a constant-voltage source.

The coil driving circuits 40A to 40N, and 40P of the speaker driving circuit 40 may also be formed from constant-voltage sources. FIG. 11 shows an example of such a case in which a control-type constant-voltage source 42, four FETs 51 to 54 each serving as a switching element, and a corresponding coil, namely, a coil 1A in the case of the coil driving circuit 40A, are bridge-connected.

When the FETs 51 and 53 are turned on and the FETs 52 and 54 are turned off, an electric current flows in a positive direction through a corresponding coil by the constant-voltage source 42. When the FETs 51 and 53 are turned off and the FETs 52 and 54 are turned on, an electric current flows in a negative direction through a corresponding coil by the constant-voltage source 42.

However, in this case of constant-voltage driving, since the number of turns of the respective coils 1A to 1N, and 1P of the primary coil 1 are different, the output impedance of the constant-voltage source 42 is different for each of the coil driving circuits 40A to 40N, and 40P, and even if the voltage value of the constant-voltage source 42 is maintained constant, the values of the electric currents which flow through the respective coils 1A to 1N, and 1P differ. For this reason, the gain of the constant-voltage source 42 is adjusted with a resistor 43 for adjustment so that the values of electric currents flowing through the respective coils 1A to 1N, and 1P become equal.

The coil driving circuits 40A to 40N, and 40P may also be formed into a structure in which the constant-current source fixed to a corresponding primary coil is controlled on the basis of tri-valued data from the decoder 70.

Figure 12:
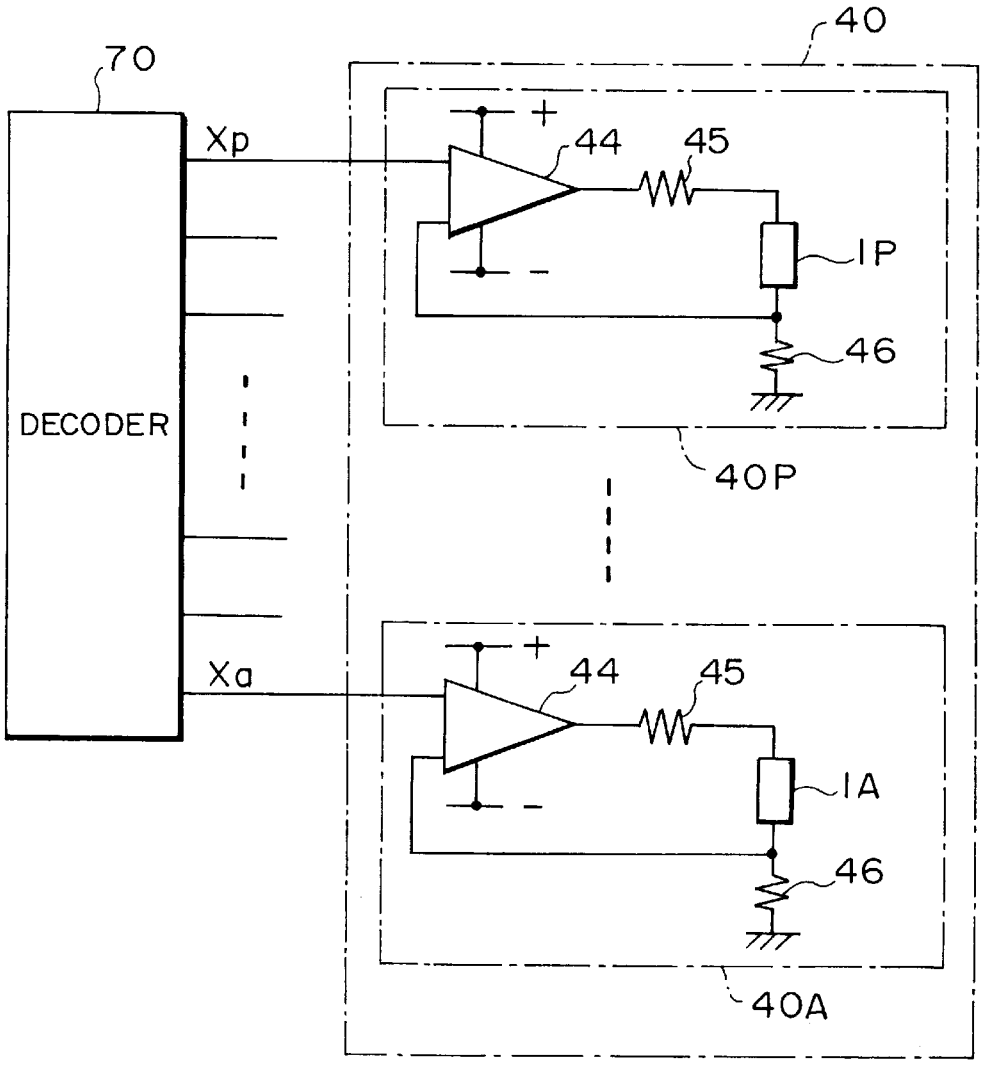
FIG. 12 is a connection diagram illustrating another example of the coil driving circuit.

FIG. 12 shows an example of such a case in which data Xa to Xp of each bit, excluding MSB, of the digital sound signal from the serial-parallel converter 220 are obtained as tri-valued data from the decoder 70. The data Xa to Xp are respectively supplied to the positive-side input terminals of a differential-type constant-current source 44, and the output terminals of the constant-current source 44 are grounded via resistors 45, corresponding coils 1A to 1N, and 1P, and resistors 46, and the voltages obtained at the connection point between the corresponding coils 1A to 1N, and 1P and the resistors 46 are supplied to the negative-side input terminal of the constant-current source 44. The resistance value of the resistors 46 is set to, for example, 0.1Ω.

The data Xa to Xn, and Xp become positive voltages when the MSB of the digital sound signal from the serial-parallel converter 220 is 0 and the corresponding lower-order bits (LSB to 2SB) are 1, become grounding potentials when the MSB is 0 and the corresponding lower-order bits are also 0, and become negative voltages when the MSB is 1 and the corresponding lower-order bits are 0.

Figure 13:
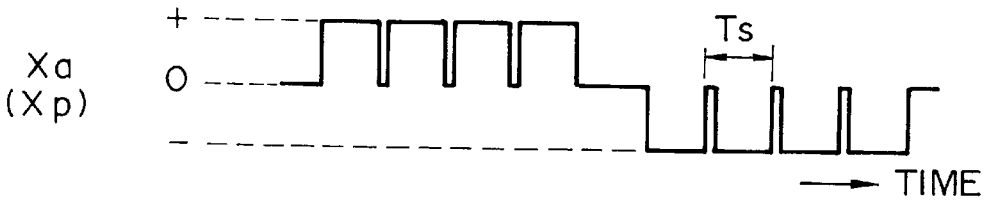
FIG. 13 is a timing waveform of a signal present in the coil driving circuit shown in FIG. 12.

Also in this case, as shown in FIG. 13, a period of the grounding potential during which a signal current does not flow through the corresponding coils 1A to 1N, and 1P is set in the data Xa to Xn, and Xp every sampling cycle Ts, which period is an amount of time shorter than the sampling cycle Ts.

In this example, when the data Xa to Xp are positive voltages, a constant electric current flows in a positive direction through the corresponding coils 1A to 1P, when the data Xa to Xn, and Xp are grounding potentials, no electric current flows through the corresponding coils 1A to 1N, and 1P, and when the data Xa to Xn, and Xp are negative voltages, a constant electric current flows in a negative direction through the corresponding coils 1A to 1N, and 1P.

Therefore, similar to the example of FIG. 7, when the MSB of the digital sound signal from the serial-parallel converter 220 is 0 and only when a certain lower-order bit is 1, a signal current flows in a positive direction through a primary coil corresponding to this bit. When, in contrast, the MSB is 1 and only when a certain lower-order bit is 0, a signal current flows in a negative direction through a primary coil corresponding to this bit. According to this example, switching elements, such as FETs 51 to 54, are not required, and the coil driving circuits 40A to 40N, and 40P can be simplified.

The above-described example shows a case in which, by setting the number of turns of each of the coils 1A to 1N, and 1P which form the primary coil 1 to a number of turns proportional to the weight of each bit, excluding the MSB, of the digital sound signal from-the serial-parallel converter 220, the difference in the weights of each bit of the digital sound signal is reproduced. However, by setting identical numbers of turns for each of the coils 1A to 1N, and 1P and by changing the electric current values of the constant-current sources 41A to 41N, and 41P of the coil driving circuits 40A to 40N, and 40P corresponding to these coils, the difference in the weights of each bit of the digital sound signal from the serial-parallel converter 220 may also be reproduced.

Figure 14:
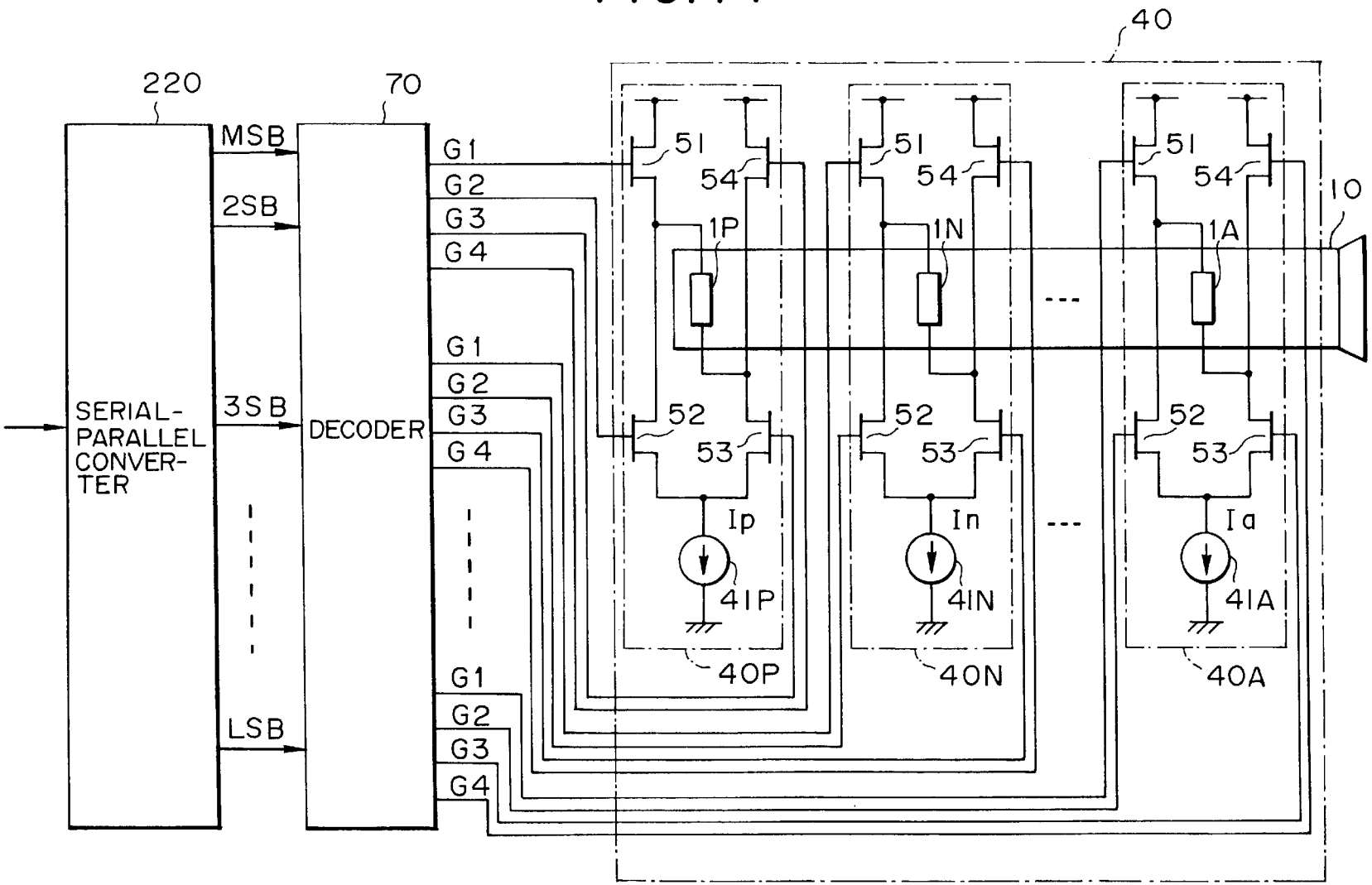
FIG. 14 is a connection diagram illustrating another example of the speaker apparatus of the present invention.

FIG. 14 shows an example of such a case in which 15 coils 1A to 1N, 1P which form the primary coil 1 are made to have the same number of turns, for example, 10 turns, Electric currents Ia to In, and Ip of the respective constant-current sources 41A to 41N, and 41P of the coil driving circuits 40A to 40N, and 40P flowing to the coils 1A to 1N, and 1P are changed as will be described later. The other elements of FIG. 14 are the same as those of the example of FIG. 7.

As described above, the driving force F of the vibration system of the speaker unit 10 is proportional to the secondary electric current i induced in the secondary coil 2, and the secondary electric current i is proportional to the product of the signal current flowing through the primary coil 1 and the number of turns (impedance) of the primary coil 1.

For this reason, in this example, though omitted in FIG. 14, the electric current Ib of the constant-current source of the coil driving circuit corresponding to the coil 1B corresponding to the 15SB of the digital sound signal from the serial-parallel converter 220 is made twice the electric current Ia of the constant-current source 41A of the coil driving circuit 40A corresponding to the coil 1A corresponding to the LSB, namely, Ib=2Ia.

Hereinafter, the electric currents Ic, Id, Ie . . . of the constant-current sources of the coil driving circuit corresponding to the coils 1C, 1D, 1E . . . corresponding to 14SB, 13SB, 12SB . . . are twice the electric currents Ib, Ic, Id . . .

Therefore, similar to the example of FIG. 7, in the speaker unit 10, the cone 32 deflects by an amount proportional to the weight of the bit corresponding to the primary coil through which the signal current flows in a direction responsive to the value of the MSB of the digital sound signal from the serial-parallel converter 220, and thus sound is reproduced faithfully to the digital sound signal from the serial-parallel converter 220.

Furthermore, in a case where the difference in the weights of each bit of the digital sound signal is reproduced by changing the electric current value of the constant-current source as described above, one primary coil 1 may be used.

Figure 15:
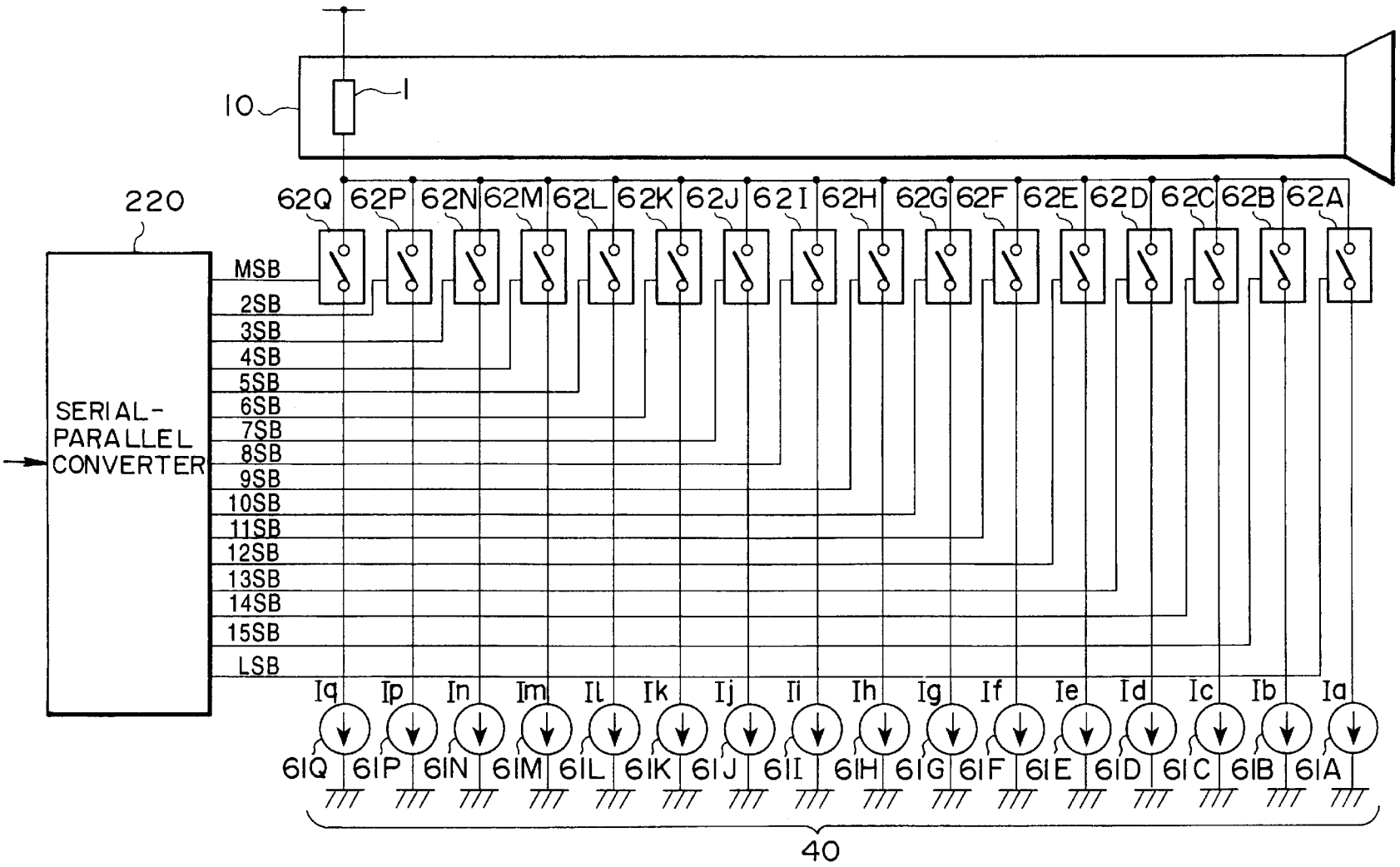
FIG. 15 is a connection diagram illustrating still another example of the speaker apparatus of the present invention.

FIG. 15 shows an example of such a case. However, this example is a case in which the 16-bit digital sound signal from the serial-parallel converter 220 is a natural binary code, or a case in which the digital sound signal of a two's complement code shown in FIG. 5 is converted into a natural binary code by the serial-parallel converter 220.

In this example, the primary coil 1 is formed of one coil, and with respect to the primary coil 1, constant-current sources 61A, 61B to 61N, and 61P of electric currents Ia, Ib to In, Ip, and Iq, each of which will be described later, are respectively connected via switching circuits 62A, 62B to 62N, and 62P. The switching circuits 62A, 62B to 62N, and 62P are switched on the basis of the data of a corresponding bit of the digital sound signal from the serial-parallel converter 220.

That is, when a certain bit of the digital sound signal from the serial-parallel converter 220 is 1, a corresponding switching circuit is turned on, causing an electric current of the corresponding constant-current source to flow through the primary coil 1. The electric current Ib of the constant-current source 61B corresponding to 15Sb is made twice the electric current Ia of the constant-current source 61A corresponding to the LSB. Hereinafter, the electric current of the constant-current source corresponding to each bit is made twice the electric current of the constant-current source corresponding to the bit one order lower.

Therefore, in this example, in the speaker unit 10, the cone 32 deflects in one direction by an amount proportional to the weight of each bit of the digital sound signal from the serial-parallel converter 220, and thus sound is reproduced faithfully from the digital sound signal supplied by the serial-parallel converter 220.

Even in a case in which the digital sound signal from the serial-parallel converter 220 is a two's complement code as shown in FIG. 5, it is possible to use one primary coil 1 by forming the coil driving circuits 40A to 40P as shown in FIG. 14 so they can be switched on the basis of the data of each bit excluding the MSB of the digital sound signal.

Furthermore, it is also possible to reproduce the difference in weights of each bit of the digital sound signal by combining the difference in the number of turns of a plurality of primary coils and the difference in the electric current values of a plurality of constant-current sources.

Figure 16:
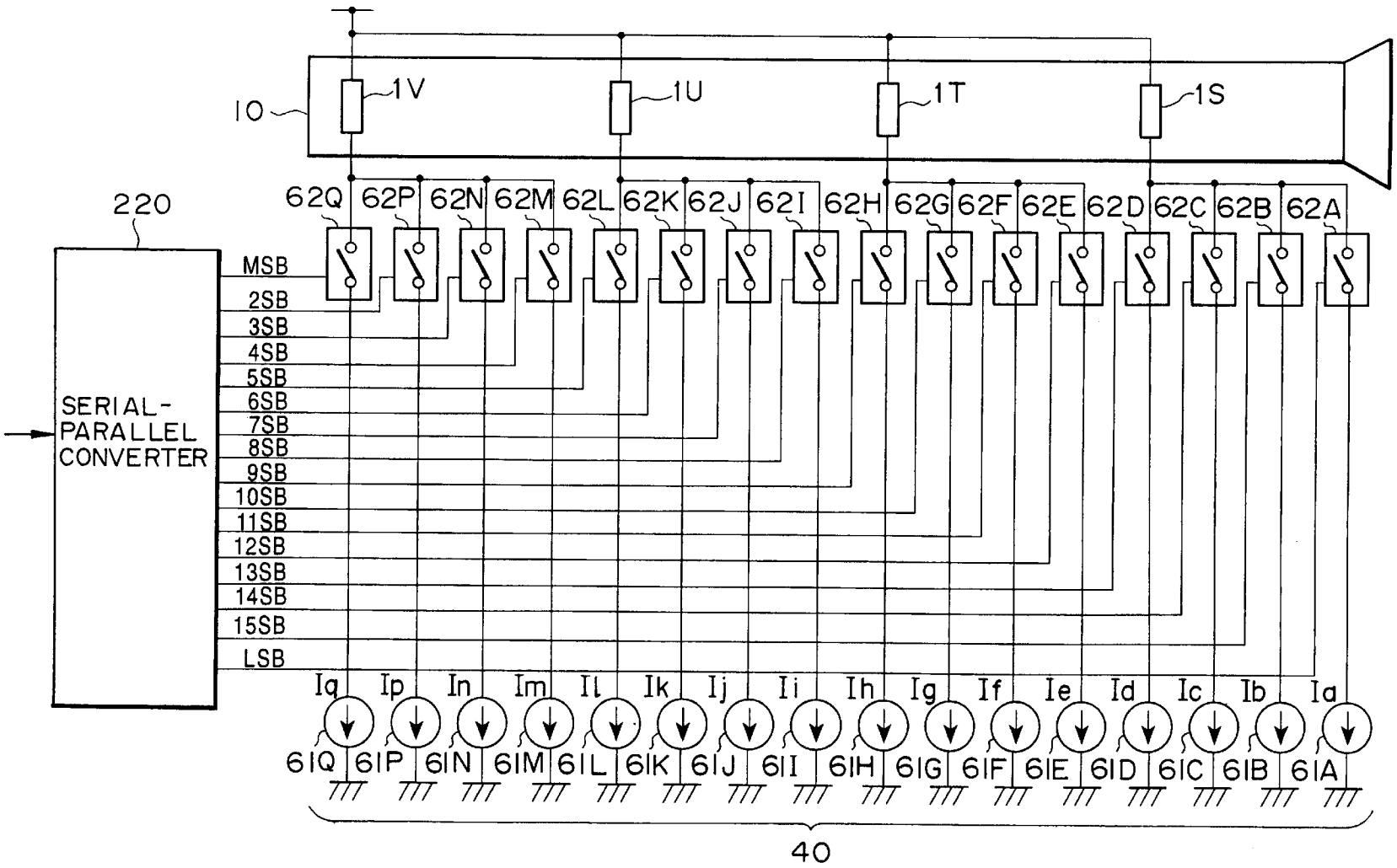
FIG. 16 is a connection diagram illustrating yet still another example of the speaker apparatus of the present invention.

FIG. 16 shows an example of such a case. However, this example is also a case in which the 16-bit digital sound signal from the serial-parallel converter 220 is a natural binary code, or a case in which the digital sound signal of a two's complement code shown in FIG. 5 is converted into a natural binary code by the serial-parallel converter 220.

In this example, the primary coil 1 is formed of four coils 1S, 1T, 1U and 1V having a number-of-turns ratio to be described later. With respect to the coil 1S, constant-current sources 61A to 61D of electric currents Ia to Id, each of which will be described later, are respectively connected via switching circuits 62A to 62D. With respect to the coil 1T, constant-current sources 61E to 61H of electric currents Ie to Ih, each of which will be described later, are respectively connected via switching circuits 62E to 62H. With respect to the coil 1U, constant-current sources 61I to 61L of electric currents Ii to Il, each of which will be described later, are respectively connected via switching circuits 62I to 62L. With respect to the coil 1V, constant-current sources 61M, 61N, 61P and 61Q of electric currents Im, In, Ip and Iq, each of which will be described later, are respectively connected via switching circuits 62M, 62N, 62P and 62Q. The switching circuits 62A, 62B to 62N, 62P and 62Q are switched on the basis of data of the corresponding bit of the digital sound signal from the serial-parallel converter 220.

For example, the ratio of the number of turns of the coils 1S, 1T, 1U and 1V are set to 1:4:16:64, and the electric currents Ia to In, Ip and Iq are set as follows:

$Ib=2Ia$, $Ic=2^2Ia$, $Id=2^3Ia$, $Ie=Ic=2^2Ia$, $If=Id=2^3Ia$, $Ig=2^4Ia$, $Ih=2^5Ia$, $Ii=Ig=2^4Ia$, $Ij=Ih=2^5Ia$, $Ik=2^6Ia$, $Il=2^7Ia$, $Im=Ik=2^6Ia$, $In=Il=2^7Ia$, $Ip=2^8Ia$, and $Iq=2^9Ia$.

As described above, the driving force F of the vibration system of the speaker unit 10 is proportional to the secondary electric current i induced in the secondary coil 2, and the secondary electric current i is proportional to the product of the signal current flowing through the primary coil 1 and the number of turns (impedance) of the primary coil 1.

Therefore, in this example, as a result of a certain bit of the digital sound signal from the serial-parallel converter 220 becoming 1, a corresponding switching circuit of the switching circuits 62A to 62N, 62P and 62Q switches on, causing a signal current to flow through the primary coil 1S, 1T, 1U or 1V. As a result, the ratio of the secondary electric currents induced in the secondary coil 2 becomes equal to the ratio of the weights of each bit of the digital sound signal from the serial-parallel converter 220.

Therefore, similar to the example of FIG. 15, in the speaker unit 10, the cone 32 deflects in one direction by an amount proportional to the weight of each bit of the digital sound signal from the serial-parallel converter 220, and thus sound is reproduced faithfully to the digital sound signal from the serial-parallel converter 220.

In this example, the ratio of the number of turns between the coil 1S having a minimum number of turns and the coil 1V having a maximum number of turns can be decreased to $1:64=1:2^6$, and further the ratio of the electric current values between the minimum electric current value Ia and the maximum electric current value Iq can be decreased to $1:2^9$.

Each of the above-described examples is a case in which the digital sound signal which drives the primary coil 1 of the speaker unit 10 is driven is quantized linearly, and the number of turns of the plurality of coils when the primary coil 1 is formed of the plurality of coils, or the electric current value corresponding to each bit excluding the MSB of the digital sound signal or each bit including the MSB of the digital sound signal can be changed in a geometric series manner. However, in a case in which the digital sound signal which drives the primary coil 1 is quantized in a non-linear manner, the number of turns of a plurality of coils when the primary coil 1 is formed of the plurality of the coils, or the electric current value of the constant-current source corresponding to each bit excluding the MSB of the digital sound signal or each bit including the MSB of the digital sound signal, may be changed according to the mode of quantization.

Figure 17:
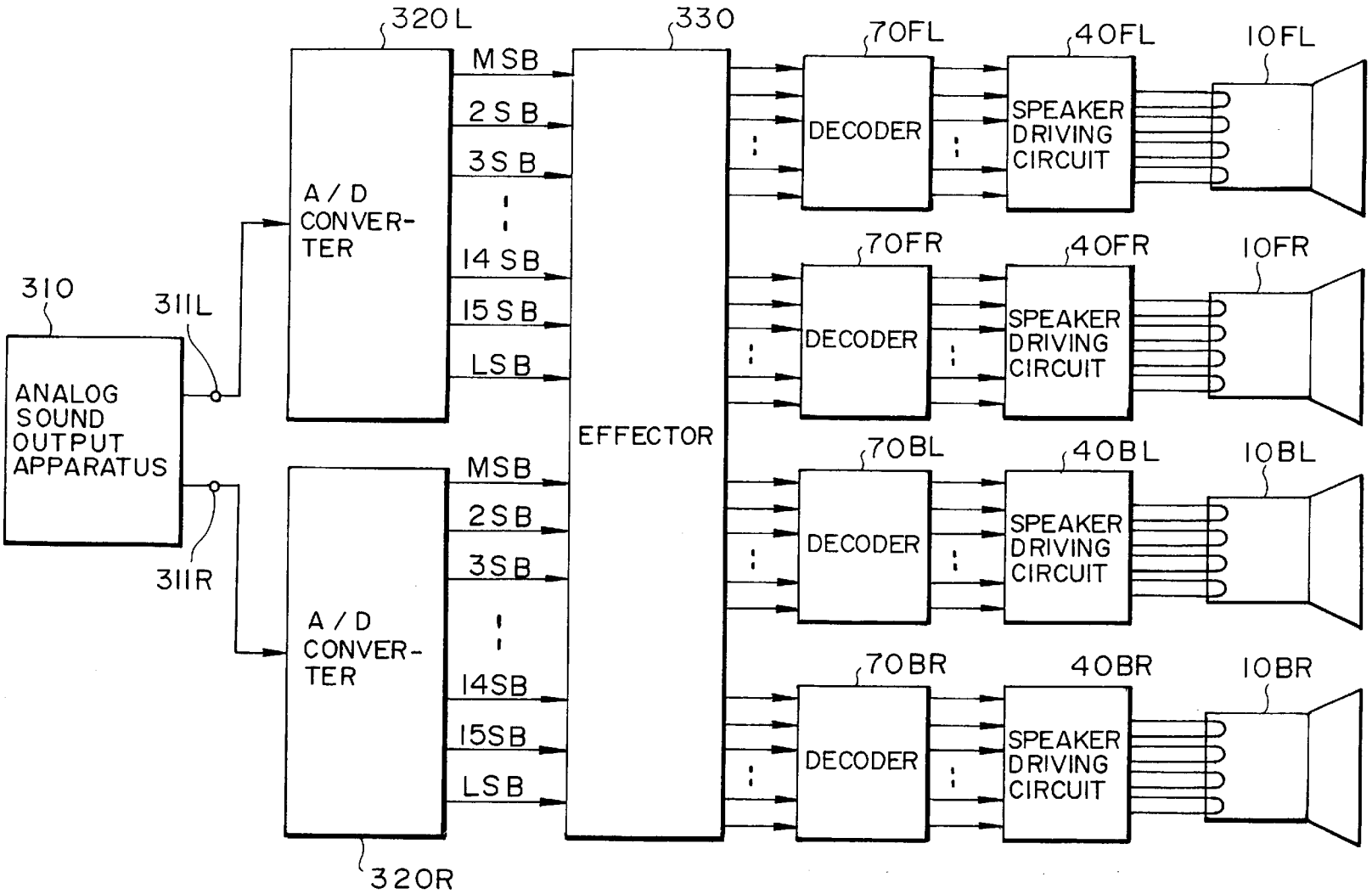
FIG. 17 is a block diagram illustrating another example of the sound reproduction system employing the speaker apparatus of the present invention.

FIG. 17 shows another example of the sound reproduction system employing the speaker apparatus of the present invention in which an analog sound signal from an analog sound output apparatus is converted into a digital sound signal, and further the digital sound signal is processed to reproduce sound.

An analog sound output apparatus 310 is a cassette player, an FM tuner or the like. Left and right analog sound signals are output from left and right sound output terminals 311L and 311R thereof, and the left and right analog sound signals are converted into 16-bit digital sound signals respectively by A/D converters 320L and 320R.

The left and right digital sound signals from the A/D converters 320L and 320R are supplied to an effector 330 using a DSP (digital signal processor) or the like. Processes, such as localization of a sound image, formation of a sound field and generation of reverberating sound, are performed by the effector 330 whereby front and back and left and right digital sound signals, each of which is 16 bits, can be obtained, and each of the front and back and left and right digital sound signals is supplied to the speaker apparatuses, respectively.

Each speaker apparatus comprises a decoder 70FL, 70FR, 70BL or 70BR, a speaker driving circuit 40FL, 40FR, 40BL or 40BR, and a speaker unit 10FL, 10FR, 10BL or 10BR. The speaker driving circuits 40FL, 40FR, 40BL and 40BR are each formed the same as the above-described speaker driving circuit 40, and the speaker units 10FL, 10FR, 10BL and 10BR are each formed the same as the above-described speaker unit 10.

According to the sound reproduction system of this example, for example, components from the A/D converters 320L and 320R to the speaker driving circuits 40FL, 40FR, 40BL and 40BR are formed into one unit and this is connected to the analog sound output apparatus 310, and further speaker units 10FL, 10FR, 10BL and 10BR are connected thereto, or components from the A/D converters 320L and 320R to the speaker units 10FL, 10FR, 10BL, and 10BR are formed into one unit and this is connected to the analog sound output apparatus 310. In this way, an input analog sound signal can be converted into a digital sound signal, and after the digital sound signal is processed, sound can be reproduced.

Also, the sound reproduction system shown in FIG. 1 is structured so that a digital sound signal from the serial-parallel converter 220 is processed similarly, and the processed digital sound signal is supplied to the speaker apparatus.

Figure 18:
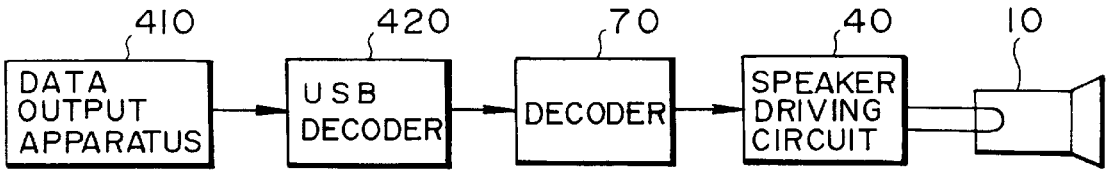
FIG. 18 is a block diagram illustrating still another example of the sound reproduction system employing the speaker apparatus of the present invention.

FIG. 18 shows still another example of the sound reproduction system employing the speaker apparatus of the present invention, and also illustrates a case in which sound data is separated from the data from the data output apparatus, and sound is reproduced.

A data output apparatus 410 is a personal computer or the like. From this data output apparatus 410, data such that digital sound signal data and other data are integrated in a predetermined format is output as serial data.

The data from the data output apparatus 410 is then supplied to a USB (Universal Serial Bus) decoder 420 whereby only the digital sound signal data is output as parallel data, and the digital sound signal is supplied to the decoder 70 of the above-described speaker apparatus formed of the decoder 70, the speaker driving circuit 40, and the speaker unit 10.

According to the sound reproduction system of this example, for example, components from the USB decoder 420 to the speaker driving circuit 40 are formed into one unit and this is connected to the data output apparatus 410, and further, the speaker unit 10 is connected thereto, or components from the USB decoder 420 to the speaker unit 10 are formed into one unit and this is connected to the data output apparatus 410. In this way, sound can be reproduced using sound data present in integrated data from a personal computer or the like.

Figure 19:
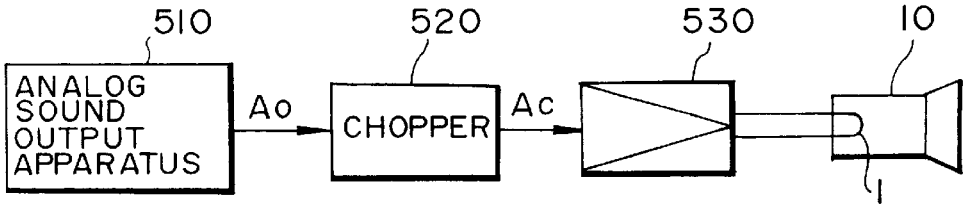
FIG. 19 is a block diagram illustrating a sound reproduction system employing another example of the speaker apparatus of the present invention.
Figure 20:
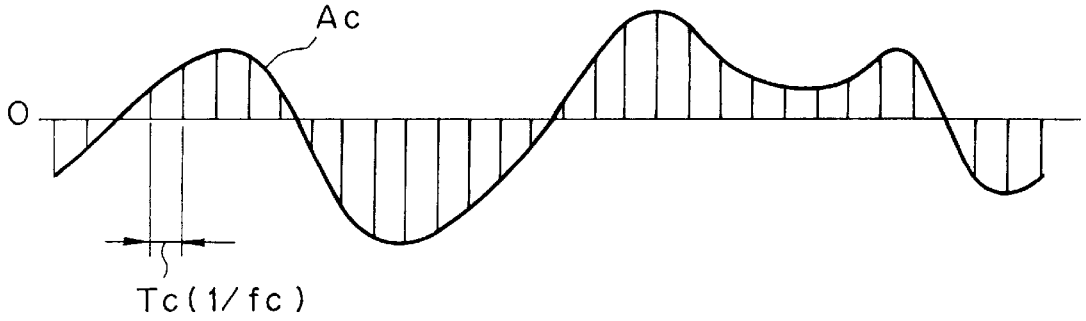
FIG. 20 is a waveform illustrating operation of the speaker apparatus of FIG. 19.

FIG. 19 shows a sound reproduction system employing another example of the sound reproduction system of the present invention. In this example, an analog sound signal Ao from an analog sound output apparatus 510, such as a cassette player or an FM tuner, is supplied to a chopper 520 whereby the signal is chopped at a frequency higher than an audible frequency, namely, a frequency fc exceeding 20 kHz, which is said to be the upper limit of audible frequencies, as indicated by an analog sound signal Ac in FIG. 20.

However, the chopping frequency fc is preferably set at a higher frequency approximately twice 20 kHz, for example, 40 kHz. Further, the time width of the chopping period is made sufficiently shorter than a chopping cycle Tc, for example, 1/10 of the chopping cycle Tc.

Then, the chopped analog sound signal Ac from the chopper 520 is amplified by a power amplifier 530 and supplied to the primary coil 1 of the above-described speaker unit 10. However, the speaker unit 10 with one primary coil 1 is used.

As described above, in the speaker unit 10 which is an electromagnetically coupled speaker, the electromagnetic coupling force at which a secondary electric current i is induced in the secondary coil 2 by the signal current flowing through the primary coil 1 is reduced, when the drive signal frequency is lowered to a value from several kHz to below 1 kHz.

However, according to the example in FIG. 19, since the analog sound signal is interrupted at a frequency fc higher than the audible frequencies and is supplied to the primary coil 1 of the speaker unit 10, the lower-frequency components of the analog sound signal also become high frequencies exceeding 20 kHz as a signal current flowing through the primary coil 1. Therefore, it becomes possible for the speaker unit 10 which is an electromagnetically coupled speaker to perform reproduction down to a low frequency.

Also, the sound reproduction system of this example is structured so that, for example, the chopper 520 and the power amplifier 530 are formed into one unit and this is connected to the analog sound output apparatus 510, and further, the speaker unit 10 is connected thereto, or components from the chopper 520 to the speaker unit 10 are formed into one unit and this is connected to the analog sound output apparatus 510.

As described above, according to the present invention, by driving a primary coil of an electromagnetically coupled speaker or by interrupting an analog sound signal supplied to a primary coil of an electromagnetically coupled speaker at a frequency higher than an audible frequency, reproduction down to a low frequency becomes possible with an electromagnetically coupled speaker, making it possible to realize a full-range speaker which reproduces from low-pitched to high-pitched sounds.

Furthermore, it is possible to realize a speaker apparatus having a small amount of distortion and a large maximum output which directly reproduces sound in accordance with a digital sound signal without using a D/A converter or a power amplifier.

Many different embodiments of the present invention may be constructed without departing from the spirit and scope of the present invention. It should be understood that the present invention is not limited to the specific embodiments described in this specification. To the contrary, the present invention is intended to cover various modifications and equivalent arrangements included within the spirit and scope of the invention as hereafter claimed. The scope of the following claims is to be accorded the broadest interpretation so as to encompass all such modifications, equivalent structures and functions.

What is claimed is:

1. A speaker apparatus comprising:

a speaker unit having a primary coil fixed to a portion of the vicinity of a gap formed in a magnetic circuit, and having a secondary coil attached to a vibration plate disposed within said gap, wherein a secondary electric current is induced in said secondary coil by a signal current flowing through said secondary coil by a signal current flowing though said primary coil, thereby causing said vibration plate to deflect; and a speaker coil of said speaker unit with a digital sound signal, wherein said primary coil is formed of a plurality of coils, each of said plurality of coils having a different number of turns corresponding to a number of bits of said digital sound signal, said speaker driving includes a plurality of coil driving circuits for respectively supplying a signal current to each of said plurality of coils corresponding to said number of bits of said digital sound signal, and each of said plurality of coil driving circuits is controlled by a corresponding bit of said digital sound signal.

2. The speaker apparatus according to claim 1, wherein each of said plurality of coil driving circuits is formed of a constant-current source bridge-connected with a plurality of switching elements.

3. The speaker apparatus according to claim 1, wherein each of said plurality of coil driving circuits is formed of a constant-voltage source bridge-connected with a plurality of switching elements.

4. The speaker apparatus according to claim 1, wherein each of said plurality of coil driving circuits is formed so that a constant-current source connected to a corresponding coil of said primary coil is controlled based on tri-valued data of a corresponding bit of said digital sound signal.

5. A sound reproduction system, comprising:

a serial-parallel converter for converting a serial digital sound signal into parallel digital data;

a speaker unit having a plurality of primary coils fixed to a portion in the vicinity of a gap formed in a magnetic circuit each of said plurality of coils having a different number of turns corresponding to a number of bits of said digital sound signal, and having a secondary coil attached to a vibration plate and disposed within said gap, wherein a secondary electric current is induced in said secondary coil by signal currents respectively flowing through said plurality of primary coils, thereby causing said vibration plate to deflect; and a speaker driving circuit including a plurality of coil driving circuits for respectively supplying a signal current to each of said plurality of primary coils of said speaker unit with said parallel digital data converted by said serial-parallel converter, wherein each of said plurality of coil driving circuits is controlled by a corresponding bit of said digital sound signal.

6. A sound reproduction system, comprising:

digital sound signal processing means for processing a digital sound signal;

a speaker unit having a plurality of primary coils fixed to a portion in the vicinity of a gap formed in a magnetic circuit each of said plurality of coils having a different number of turns corresponding to a number of bits of said digital sound signal, and having a secondary coil attached to a vibration plate and disposed within said gap, wherein a secondary electric current is induced in said secondary coil by signal currents respectively flowing through said plurality of primary coils, thereby causing said vibration plate to defect; and a speaker driving circuit including a plurality of coil driving circuits for respectively supplying a signal current to each of said plurality of primary coils of said speaker unit with said digital sound signal processed by said digital sound signal processing means, wherein each of said plurality of coil driving circuits is controlled by a corresponding bit of said digital sound signal.

7. A sound reproduction system, comprising:

digital sound signal separation means for separating digital sound signal data from other data when said digital sound signal data and said other data are integrated in a predetermined format;

a speaker unit having a plurality of primary coils fixed to a portion in the vicinity of a gap formed in a magnetic circuit, each of said plurality of coils having a different number of turns corresponding to a number of bits of said digital sound data, and having a secondary coil attached to a vibration plate and disposed within said gap, wherein a secondary electric current is induced in said secondary coil by signal currents flowing through said plurality of primary coils, thereby causing said vibration plate to deflect; and a speaker driving circuit including a plurality of coil driving circuits for respectively supplying a signal current to each of said plurality primary coils of said speaker unit with said digital sound signal data separated by said digital sound signal separation means, wherein each of said plurality of coil driving circuits is controlled by a corresponding bit of said digital sound signal data.

8. A speaker apparatus, comprising:

a speaker unit having a primary coil fixed to a portion in the vicinity of a gap formed in a magnetic circuit, and having a secondary coil attached to a vibration plate and disposed within said gap, wherein a secondary electric current is induced in said secondary coil by a signal current flowing through said primary coil, thereby causing said vibration plate to deflect; and a speaker driving circuit which drives said primary coil of said speaker unit with an analog sound signal, wherein said speaker driving circuit includes a chopper circuit for chopping said analog sound signal at a frequency higher than an audible frequency and a time width of a chopping period is shorter than a chopping cycle.

* * * * *